US006364689B1

(12) United States Patent
Urso et al.

(10) Patent No.: US 6,364,689 B1
(45) Date of Patent: Apr. 2, 2002

(54) CONDUCTOR PIERCING WASHER DEVICE FOR A FASTENING MEMBER

(76) Inventors: Robert J. Urso; Jan M. Urso, both of 489 Cottage Hill Ave., Elmhurst, IL (US) 60126

( * ) Notice: Subject to any disclaimer, the term of this patent is extended or adjusted under 35 U.S.C. 154(b) by 0 days.

(21) Appl. No.: 09/759,077

(22) Filed: Jan. 12, 2001

(51) Int. Cl.[7] ..... H01R 4/24
(52) U.S. Cl. ..... 439/411; 411/533
(58) Field of Search ..... 439/411, 97, 581, 439/620, 939; 411/186–188, 116, 339, 533, 37, 970, 999, 372, 155, 156

(56) References Cited

U.S. PATENT DOCUMENTS 3,585,571 A 6/1971 Davis
3,594,703 A 7/1971 Holtzapple
3,674,916 A 7/1972 Langella
4,050,761 A 9/1977 De France
D264,552 S 5/1982 Bogren
4,547,033 A 10/1985 White et al.
5,827,028 A * 10/1998 Swick ..... 411/36

* cited by examiner

*Primary Examiner*—Tho D. Ta
*Assistant Examiner*—Phuongchi Nguyen

(57) ABSTRACT

A conductor piercing washer device for a fastening member for making electrical contact with the conducting wires without having to strip the wires. The conductor piercing washer device for a fastening member includes a fastening member having a shaft portion and a head portion; and also includes a washer member being removably mounted about the shaft portion of the fastening member; and further includes a washer stopper member being securely attached about the shaft portion of the fastening member and being spaced from the head portion of the fastening member.

4 Claims, 2 Drawing Sheets

CONDUCTOR PIERCING WASHER DEVICE FOR A FASTENING MEMBER

BACKGROUND OF THE INVENTION

1. Field of the Invention

The present invention relates to a fastening member with a conductor piercing washer member and more particularly pertains to a new conductor piercing washer device for a fastening member for making electrical contact with the conducting wires without having to strip the wires.

2. Description of the Prior Art

The use of a fastening member with a conductor piercing washer member is known in the prior art. More specifically, a fastening member with a conductor piercing washer member heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,674,916; 4,547,033; 4,050,761; 3,594,703; 3,585,571; and U.S. Pat. No. Des. 264,552.

While these devices fulfill their respective, particular objectives and requirements, the aforementioned patents do not disclose a new conductor piercing washer device for a fastening member. The inventive device includes a fastening member having a shaft portion and a head portion; and also includes a washer member being removably mounted about the shaft portion of the fastening member; and further includes a washer stopper member being securely attached about the shaft portion of the fastening member and being spaced from the head portion of the fastening member.

In these respects, the conductor piercing washer device for a fastening member according to the present invention substantially departs from the conventional concepts and designs of the prior art, and in so doing provides an apparatus primarily developed for the purpose of making electrical contact with the conducting wires without having to strip the wires.

SUMMARY OF THE INVENTION

In view of the foregoing disadvantages inherent in the known types of fastening member with conductor piercing washer member now present in the prior art, the present invention provides a new conductor piercing washer device for a fastening member construction wherein the same can be utilized for making electrical contact with the conducting wires without having to strip the wires.

The general purpose of the present invention, which will be described subsequently in greater detail, is to provide a new conductor piercing washer device for a fastening member which has many of the advantages of the fastening member with conductor piercing washer member mentioned heretofore and many novel features that result in a new conductor piercing washer device for a fastening member which is not anticipated, rendered obvious, suggested, or even implied by any of the prior art fastening member with conductor piercing washer member, either alone or in any combination thereof.

To attain this, the present invention generally comprises a fastening member having a shaft portion and a head portion; and also includes a washer member being removably mounted about the shaft portion of the fastening member; and further includes a washer stopper member being securely attached about the shaft portion of the fastening member and being spaced from the head portion of the fastening member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new conductor piercing washer device for a fastening member which has many of the advantages of the fastening member with conductor piercing washer member mentioned heretofore and many novel features that result in a new conductor piercing washer device for a fastening member which is not anticipated, rendered obvious, suggested, or even implied by any of the prior art fastening member with conductor piercing washer member, either alone or in any combination thereof.

It is another object of the present invention to provide a new conductor piercing washer device for a fastening member which may be easily and efficiently manufactured and marketed.

It is a further object of the present invention to provide a new conductor piercing washer device for a fastening member which is of a durable and reliable construction.

An even further object of the present invention is to provide a new conductor piercing washer device for a fastening member which is susceptible of a low cost of manufacture with regard to both materials and labor, and which accordingly is then susceptible of low prices of sale to the consuming public, thereby making such conductor piercing washer device for a fastening member economically available to the buying public.

Still yet another object of the present invention is to provide a new conductor piercing washer device for a fastening member which provides in the apparatuses and methods of the prior art some of the advantages thereof, while simultaneously overcoming some of the disadvantages normally associated therewith.

Still another object of the present invention is to provide a new conductor piercing washer device for a fastening member for making electrical contact with the conducting wires without having to strip the wires.

Yet another object of the present invention is to provide a new conductor piercing washer device for a fastening member which includes a fastening member having a shaft portion and a head portion; and also includes a washer member being removably mounted about the shaft portion of the fastening member; and further includes a washer stopper member being securely attached about the shaft portion of the fastening member and being spaced from the head portion of the fastening member.

Still yet another object of the present invention is to provide a new conductor piercing washer device for a fastening member that is easy and convenient to use without the user having to strip the conducting wires.

Even still another object of the present invention is to provide a new conductor piercing washer device for a fastening member that is safe and reduces the risk of electrocution and of the user cutting oneself with the wire stripper.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
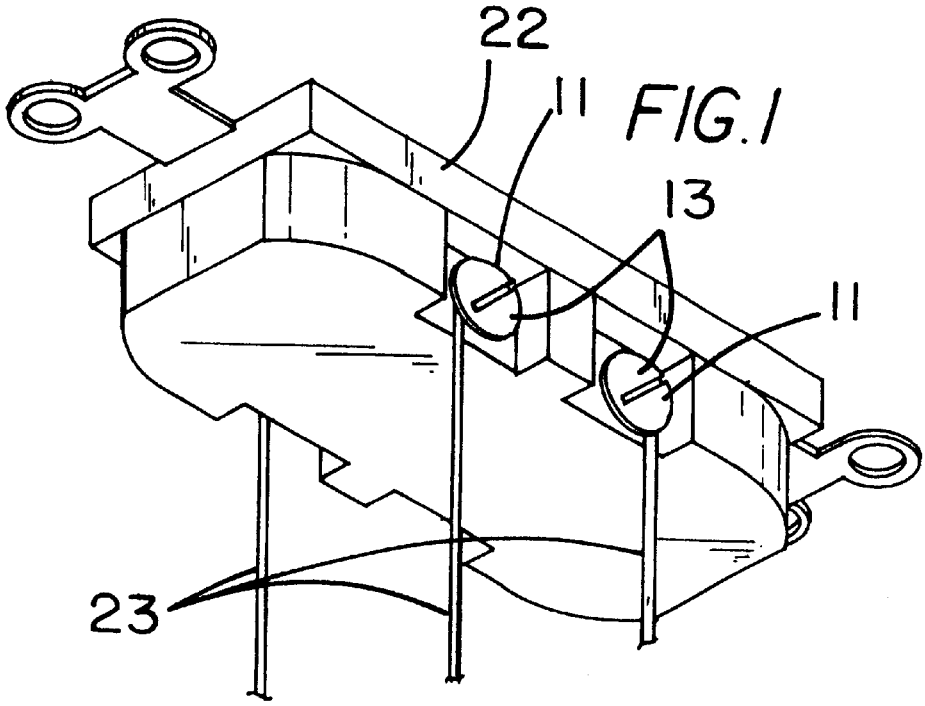
FIG. 1 is a perspective view of a new conductor piercing washer device for a fastening member according to the present invention and shown in use.
Figure 2:
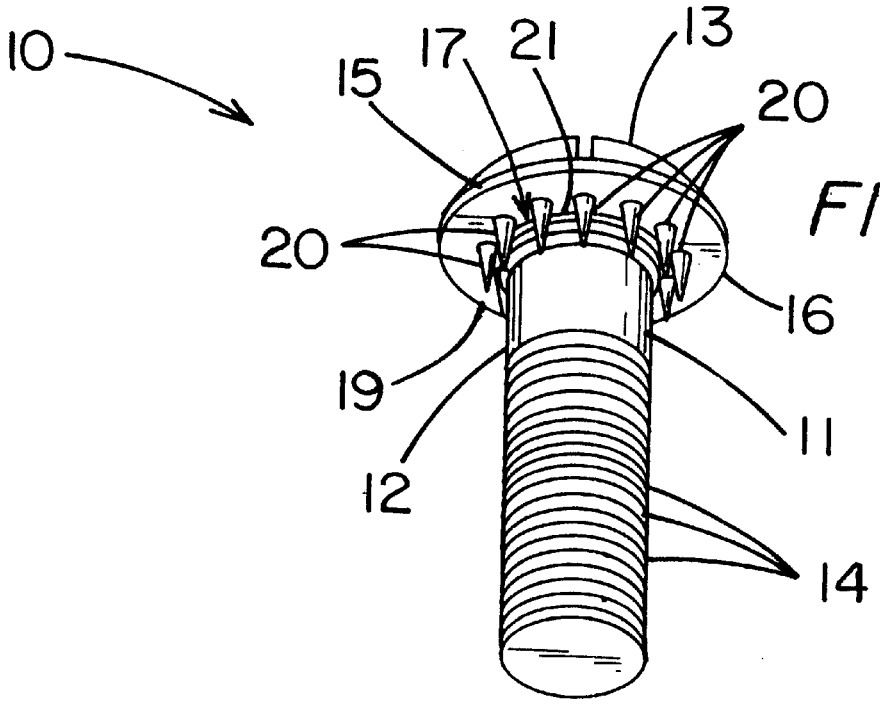
FIG. 2 is a perspective view of the present invention.
Figure 3:
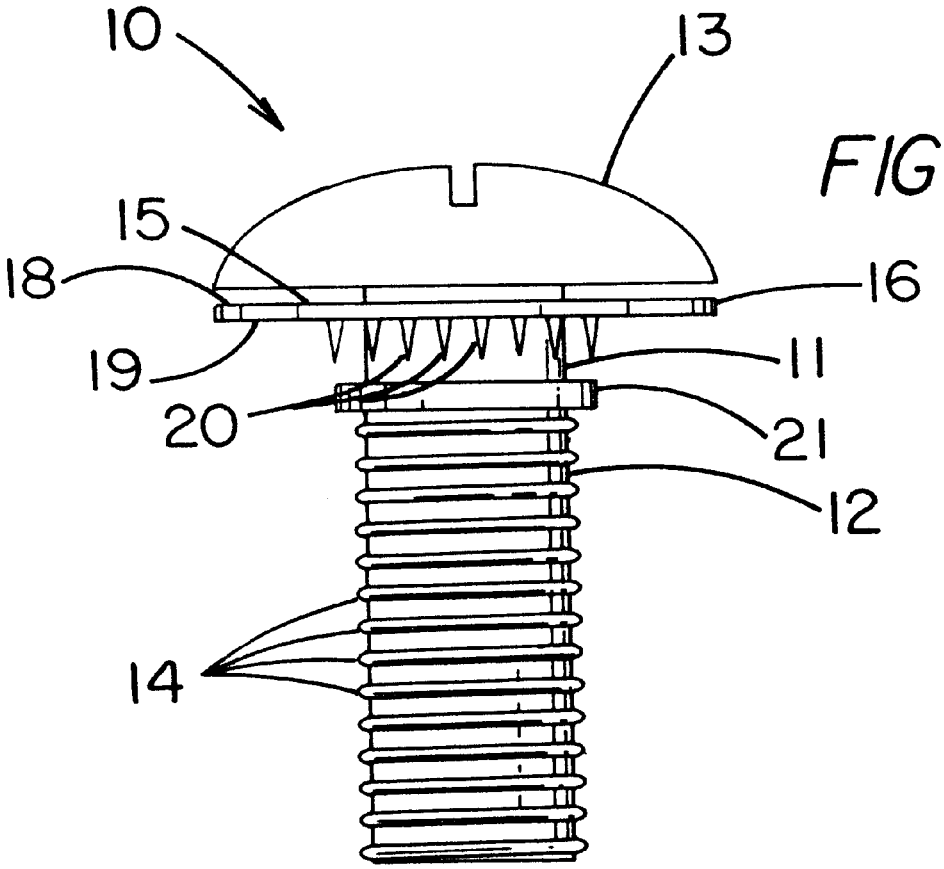
FIG. 3 is a cross-sectional view of the present invention.

With reference now to the drawings, and in particular to FIGS. 1 through 3 thereof, a new conductor piercing washer device for a fastening member embodying the principles and concepts of the present invention and generally designated by the reference numeral 10 will be described.

As best illustrated in FIGS. 1 through 3, the conductor piercing washer device for a fastening member 10 generally comprises a fastening member 11 having a shaft portion 12 and a head portion 13 with the shaft portion 12 of the fastening member 11 including a threaded lower portion 14.

A washer member 15 is removably mounted about the shaft portion 12 of the fastening member 11. The washer member 15 includes a disc-like member 16 having a top side 18 and a bottom side 19, and also includes a plurality of tines 20 being securely and conventionally attached to and extending outwardly from the bottom side 19 of the disc-like member 16. The disc-like member 16 has a centrally-disposed hole 17 extending therethrough with the centrally-disposed hole 17 being adapted to receive the shaft portion 12 of the fastening member 11 therethrough. The tines 20 areg aligned in a circular arrangement about and being spaced from the centrally-disposed hole 17.

A washer stopper member 21 is securely and conventionally attached about the shaft portion 12 of the fastening member 11 and is spaced from the head portion 13 of the fastening member 11. The washer stopper member 21 is an annular flange being securely and conventionally attached about the shaft portion 12 of the fastening member 11 with the annular flange 21 and the washer member 15 being adapted to engage and pierce a conductor member 23 such as a wire therebetween upon the fastening member 11 being fastened to an object 22. A line connecting tips of the tines 20 forms a circle. The washer stopper member 21 has an outer perimeter. The diameter of the circle of the line connecting tips is substantially equal to the diameter of the outer perimeter of the washer stopper 21 such that the washer stopper 21 is adapted to press a conductor member 23 against the tips of the plurality of tines 20.

In use, the user threads the fastening member 11 into the object 22 such as switches, outlets and other electrical devices and places the conductor wire 23 between the washer member 15 and the washer stopper member 21 and continues to thread the fastening member 11 into the object 22 until the tines 20 engage and pierce through the conductor wire 23 to make electrical contact with the current conducting wire element.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A conductor piercing fastening device comprising:

a fastening member having a shaft portion and a head portion, said shaft portion of said fastening member including a threaded lower portion;

a washer member being removably mounted about said shaft portion of said fastening member, said washer member including a disc-like member having a top side and a bottom side, and also including a plurality of tines being attached to and extending outwardly from said bottom side of said disc-like member, said disc-like member having a centrally-disposed hole extending therethrough, said centrally-disposed hole being adapted to receive said shaft portion of said fastening member therethrough; and a washer stopper member being securely attached about said shaft portion of said fastening member and being spaced from said head portion of said fastening member, said washer stopper member being an annular flange being securely attached about said shaft portion of said fastening member;

wherein said washer member is disposed between said head portion of said fastening member and said washer stopper member;

wherein said washer member comprises a disc-like member having a top side and a bottom side, and also includes a plurality of tines formed on said the bottom side thereof, said plurality of tines extending in a direction substantially perpendicular to a surface of said bottom side, each of said tines having a substantially conical shape;

wherein said plurality of tines extend in a direction substantially perpendicular to a surface of said bottom side;

wherein a line connecting tips of said tines forms a circle, the circle defined by said tips having a first diameter measurement;

wherein said washer stopper member has an outer perimeter with a second diameter measurement; and wherein said first diameter measurement is substantially equal to said second diameter measurement such that said washer stopper is adapted to press a conductor member against the tips of said plurality of tines.

2. A conductor piercing fastening device comprising:

a fastening member having a shaft portion and a head portion;

a washer member being removably mounted about said shaft portion of said fastening member; and a washer stopper member being securely attached about said shaft portion of said fastening member and being spaced from said head portion of said fastening member, said washer stopper member comprising an annular flange securely attached about said shaft portion of said fastening member;

wherein said washer member comprises a disc-like member having a top side and a bottom side, and also includes a plurality of tines formed on said the bottom side thereof, said plurality of tines extending in a direction substantially perpendicular to a surface of said bottom side;

wherein a line connecting tips of said tines forms a circle, the circle defined by said tips having a first diameter measurement;

wherein said washer stopper member has an outer perimeter with a second diameter measurement;

wherein said first diameter measurement is substantially equal to said second diameter measurement such that said washer stopper is adapted to press a conductor member against the tips of said plurality of tines.

3. A conductor piercing fastening device as described in claim 2, wherein said shaft portion of said fastening member includes a threaded lower portion.

4. A conductor piercing fastening device as described in claim 2, wherein said disc-like member has a centrally-disposed hole extending therethrough, said centrally-disposed hole being adapted to receive said shaft portion of said fastening member therethrough.

* * * * *